US010788781B2

(12) United States Patent
Oura et al.

(10) Patent No.: US 10,788,781 B2
(45) Date of Patent: Sep. 29, 2020

(54) DECORATIVE IMAGE FORMING METHOD

(71) Applicant: Konica Minolta, Inc., Tokyo (JP)

(72) Inventors: Kazumi Oura, Kanagawa (JP); Michiyo Fujita, Tokyo (JP); Kaori Matsushima, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/600,051

(22) Filed: Oct. 11, 2019

(65) Prior Publication Data

US 2020/0150577 A1 May 14, 2020

(30) Foreign Application Priority Data

Nov. 8, 2018 (JP) ..... 2018-210730

(51) Int. Cl.
*G03G 15/20* (2006.01)
*G03G 15/00* (2006.01)

(52) U.S. Cl.
CPC ..... *G03G 15/6585* (2013.01)

(58) Field of Classification Search
USPC ..... 399/341
See application file for complete search history.

(56) References Cited

U.S. PATENT DOCUMENTS 6,593,051 B1 * 7/2003 Hirota ..... G03G 9/0819 430/108.1
2004/0086307 A1 * 5/2004 Murai ..... B65H 85/00 399/329
2009/0245903 A1 * 10/2009 Nakamura ..... G03G 15/2064 399/341
2013/0095422 A1 * 4/2013 Yamamoto ..... G03G 9/08764 430/109.4

FOREIGN PATENT DOCUMENTS

JP H01200985 A 8/1989
JP 2013178452 A 9/2013
JP 2014157249 A 8/2014

* cited by examiner

*Primary Examiner* — Quana Grainger
(74) *Attorney, Agent, or Firm* — Lucas & Mercanti, LLP

(57) ABSTRACT

The present invention provides an image forming method for forming a decorated image having a resin layer and a powder contacted with each other, the method including: forming a resin layer on a recording medium; and supplying a powder onto the recording medium, in which, in viscoelasticity measurement of the resin layer, storage modulus G'(1) at 90° C. is $1.0\times10^3$ Pa or more and $1.0\times10^6$ Pa or less upon carrying out the measurement from 30° C. to 100° C. under conditions of a frequency of 1 Hz and a temperature increasing rate of 3° C./min.

15 Claims, 3 Drawing Sheets

DECORATIVE IMAGE FORMING METHOD

CROSS REFERENCE TO RELATED APPLICATIONS

The entire disclosure of Japanese patent Application No. 2018-210730, filed on Nov. 8, 2018, is incorporated herein by reference in its entirety.

BACKGROUND

Technological Field

The present invention relates to an image forming method.

Description of Related Art

In recent years, there have been increasing demands, in the on-demand printing market, for printing in a spot color and adding more value to printed matters. Above all, demands for metallic printing, pearl printing and imparting a texture are particularly large, and various studies have been conducted.

For example, as a method of forming images with metallic luster, some methods have been examined, such as a method of transferring a metallic foil and a resin foil by utilizing a toner image (Japanese Patent Application Laid-Open No. H01-200985) and a method of using a toner containing a glittering pigment (Japanese Patent Application Laid-Open No. 2014-157249). Among them, in methods of allowing a powder to adhere to a toner image, images with metallic luster are obtained by allowing a powder having metallic luster to adhere thereto (Japanese Patent Application Laid-Open No. 2013-178452).

SUMMARY

However, even in an image forming method as described in Japanese Patent Application Laid-Open No. 2013-178452, in which a powder is used to decorate a resin layer, that powder may be likely to be detached from the toner image although it has once adhered to the toner image.

The present invention is to solve the problem described above, and an object of the present invention is to provide an image forming method in which a powder is unlikely to be detached from an image that has been decorated with the powder.

To achieve at least one of the abovementioned objects, according to an aspect of the present invention, an image forming method reflecting one aspect of the present invention is a method for forming a decorated image having a resin layer and a powder contacted with each other, the method comprising: forming a resin layer on a recording medium; and supplying a powder onto the recording medium, wherein, in viscoelasticity measurement of the resin layer, storage modulus G'(1)at 90° C. is $1.0\times10^3$ Pa or more and $1.0\times10^6$ Pa or less upon carrying out the measurement from 30° C. to 100° C. under conditions of a frequency of 1 Hz and a temperature increasing rate of 3° C./min.

To achieve at least one of the abovementioned objects, according to an aspect of the present invention, an image forming method reflecting one aspect of the present invention is a method for forming a decorated image, comprising: softening a resin layer included in a resin image including a recording medium and the resin layer formed on the recording medium; and supplying a powder onto a surface of the resin layer, wherein, in viscoelasticity measurement of the resin layer, storage modulus G'(1)at 90° C. is $1.0\times10^3$ Pa or more and $1.0\times10^6$ Pa or less upon carrying out the measurement from 30° C. to 100° C. under conditions of a frequency of 1 Hz and a temperature increasing rate of 3° C./min.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1A:
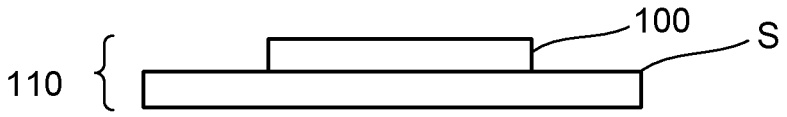
FIG. 1A is a schematic diagram illustrating a resin image including a recording medium and a resin layer disposed thereon.

Hereinafter, one or more embodiments of the present invention will be described with reference to the drawings. However, the scope of the invention is not limited to the disclosed embodiments.

Embodiments of the present invention can provide an image forming method in which a powder is unlikely to be detached from an image that has been decorated with the powder.

One embodiment of the present invention relates to an image forming method for forming a decorated image having a resin layer and a powder contacted with each other, the method including: forming a resin layer on a recording medium; and supplying a powder onto the recording medium, in which, in viscoelasticity measurement of the resin layer, storage modulus G'(1)at 90° C. is $1.0\times10^3$ Pa or more and $1.0\times10^6$ Pa or less upon carrying out the measurement from 30° C. to 100° C. under conditions of a frequency of 1 Hz and a temperature increasing rate of 3° C./min.

[Recording Medium]

The recording medium described above is not especially limited as long as a resin layer is disposed thereon. Examples of the recording medium include various kinds of media such as normal paper ranging from thin paper to cardboard, wood-free paper, coated print sheet such as art paper or coated paper, commercially available Japanese paper or postcard sheet, a plastic film, a resin film and a fabric. The recording medium is not especially limited in its color.

[Resin Layer]

The resin layer described above is not especially limited as long as it is a layer containing a resin, and in viscoelasticity measurement thereof, storage modulus G'(1)at 90° C. is $1.0\times10^3$ Pa or more and $1.0\times10^6$ Pa or less upon carrying out the measurement from 30° C. to 100° C. under conditions of a frequency of 1 Hz and a temperature increasing rate of 3° C./min.

For the resin layer, in viscoelasticity measurement thereof, storage modulus G'(1)at 90° C. is preferably $1.0\times10^3$ Pa or more and $1.0\times10^6$ Pa or less, and further preferably $1.3\times10^4$ Pa or more and $7.0\times10^5$ Pa or less upon carrying out the measurement from 30° C. to 100° C. under conditions of a frequency of 1 Hz and a temperature increasing rate of 3° C./min.

When storage modulus G'(1)is $1.0\times10^6$ Pa or less, the resin layer is appropriately softened by heating and the resin can enter the inside of irregularities on the surface of powder particles, and therefore, the contact area between the resin and the powder particles can be increased, thereby making adhesive properties of powder particles satisfactory. When storage modulus G'(1)is $1.3\times10^4$ or more, the softened resin layer has appropriate firmness and the resin layer is unlikely to collapse, and therefore, concentration difference in color of the resin layer is unlikely to occur and the underlying recording medium is unlikely to be seen.

Besides, from the viewpoint that, after being added, the powder is unlikely to be detached upon being cooled to be solidified again, for the resin layer, in viscoelasticity measurement thereof, storage modulus G'(2) at 40° C. is preferably $1.0\times10^8$ Pa or more and preferably $1.5\times10^9$ Pa or less upon carrying out the measurement from 30° C. to 100° C. under conditions of a frequency of 1 Hz and a temperature increasing rate of 3° C./min.

The resin may be appropriately selected from various known resins having thermoplasticity. Examples of the thermoplastic resin include a styrene-based resin, a (meth) acrylic-based resin, a styrene-(meth)acrylic-based copolymer resin, a vinyl-based resin such as an olefin-based resin, a polyester resin, a crystalline polyester resin, an amorphous polyester resin, a polyamide-based resin, a carbonate resin, polyether and a polyvinyl acetate-based resin. Especially, the styrene-based resin, the acrylic-based resin or the polyester resin is preferable. The resin may be appropriately selected from them such that G'(1) of the resin layer is from $1.0\times10^1$ to $1.0\times10^6$ Pa.

These thermoplastic resins previously mentioned may be used singly, or in combinations of two or more. For example, the resin preferably contains the styrene-(meth)acrylic-based copolymer resin and the polyester resin, and further preferably contains the styrene-(meth)acrylic-based copolymer resin and the crystalline polyester resin.

The crystalline polyester resin refers to a polyester resin that does not exhibit a stepwise endothermic change, but a distinct endothermic peak in differential scanning calorimetry (DSC). Specifically, the distinct endothermic peak means a peak whose half-value width is 15° C. or less in differential scanning calorimetry (DSC) upon carrying out the measurement at a temperature increasing rate of 10° C./min.

Besides, the crystalline polyester resin as described above not only means a polymer whose constituents are all composed of polyester structure, but also a polymer (copolymer) formed by copolymerizing a component constituting polyester and another component. However, in the latter case, the polymer (copolymer) contains the other constituent than polyester in an amount of 50 mass % or less.

The amorphous polyester resin is a polyester resin that does not exhibit a melting point and has a comparatively high glass transition temperature (Tg) upon carrying out differential scanning calorimetry (DSC).

It is noted that, to a polyester resin obtained by polycondensation between a polycarboxylic acid and a polyhydric alcohol, a monocarboxylic acid and/or a monoalcohol may be added to esterify hydroxyl groups and/or carboxyl groups at polymerization terminals and adjust the acid number of the polyester resin. Examples of the monocarboxylic acid include acetic acid, acetic anhydride, benzoic acid, trichloroacetic acid, trifluoroacetic acid and propionic anhydride. Examples of the monoalcohol include methanol, ethanol, propanol, octanol, 2-ethylhexanol, trifluoroethanol, trichloroethanol, hexafluoroisopropanol and phenol.

The resin layer can be formed on the recording medium by any of known image forming methods such as a dry or wet electrophotographic method and an inkjet method.

In particular, the resin layer is preferably a layer including a toner image formed by the electrophotographic method, and preferably contains a toner fixed on the recording medium.

Besides, the resin layer preferably contains a plurality of types of toners fixed on the recording medium.

When the resin layer contains a plurality of types of toners, a variety of decorated images can be formed by combining toner images and powders. The plurality of types of toners can contain, for example, a plurality of types of toner particles different in color provided by a colorant contained therein. Examples of the toner particle include a black toner particle, a white toner particle, a clear toner particle, a cyan toner particle, a yellow toner particle and a magenta toner particle.

The toner particle can be produced by adding an external additive to a toner mother particle and mixing them. Examples of a method of producing the toner mother particle include a pulverization method, an emulsion polymerization aggregation method, a suspension polymerization method, a dissolution suspension method and an emulsion aggregation method. In particular, the method of producing the toner mother particle is preferably the emulsion aggregation method and the emulsion polymerization aggregation method.

Especially, the toner mother particle used in one embodiment of the present invention is preferably obtained through a step of mixing a dispersion formed by dispersing a colorant fine particle in an aqueous medium with a dispersion formed by dispersing a resin fine particle in an aqueous medium to aggregate and fuse the colorant fine particle and the resin fine particle, that is, obtained by production methods such as the emulsion aggregation method. Such production methods are preferable because the colorant fine particle is well dispersed in the dispersion for the colorant contained in the toner mother particle, and even though the colorant fine particle and the resin fine particle are aggregated and fused, the colorant fine particle can form the toner mother particle while maintaining excellent dispersibility.

Besides, the particle size of the toner mother particle is preferably small for the purpose of improving image quality, but the number average particle size of the toner mother particle is preferably in the range of 2 to 8 μm because electrostatic properties, flowability and adhesive properties can be made suitable, and in turn, development, transferal and cleaning are not difficult. It is noted that the particle size of the toner mother particle is further preferably in the range of 4 to 7 μm from the viewpoint described above.

The toner mother particle contains, for example, a resin as described above, and preferably contains a colorant and a release agent. Besides, the toner mother particle may contain a charge control agent and a magnetic material. Now, the colorant, the release agent, the external additive, the charge control agent and the magnetic material will be descried.

For the colorant, known colorants can be used. Specific examples of the colorant contained in the yellow toner include C.I. Solvent Yellows 19, 44, 77, 79, 81, 82, 93, 98, 103, 104, 112 and 162, and C.I. Pigment Yellows 14, 17, 74, 93, 94, 138, 155, 180 and 185. These colorants may be used singly, or in combinations of two or more. Examples of the colorant contained in the magenta toner include C.I. Solvent Reds 1, 49, 52, 58, 63, 111 and 122, and C.I. Pigment Reds 5, 48:1, 53:1, 57:1, 122, 139, 144, 149, 166, 177, 178 and 222. These colorants may be used singly, or in combinations of two or more. Examples of the colorant contained in the cyan toner include C.I. Pigment Blue 15:3. Examples of the colorant contained in the black toner include carbon black, magnetic materials and titanium black. Examples of the carbon black include channel black, furnace black, acetylene black, thermal black and lamp black.

The content of the colorant is preferably 1 to 10 parts by mass and more preferably 2 to 9 parts by mass relative to 100 parts by mass of the resin.

For the release agent, various known waxes can be used. Examples of the wax include polyolefin waxes such as polyethylene wax and polypropylene wax; branched hydrocarbon waxes such as microcrystalline wax; long chain hydrocarbon-based waxes such as paraffin wax and sasol wax; dialkyl ketone-based waxes such as distearyl ketone; ester-based waxes such as carnauba wax, montan wax, behenic behenate, trimethylolpropane tribehenate, pentaerythritol tetrabehenate, pentaerythritol diacetate dibehenate, glycerin tribehenate, 1,18-octadecanediol distearate, tristearyl trimellitate and distearyl maleate; and amide-based waxes such as ethylenediamine behenylamide and tristearylamide trimellitate. Besides, these release agents may be used singly, or in combinations of two or more.

The content of the release agent is preferably 1 to 30 parts by mass and more preferably 2 to 20 parts by mass relative to 100 parts by mass of the resin.

For the external additive, conventionally known metal oxide particles can be used for the purpose of controlling flowability and electrostatic properties, and examples of the external additive include a silica particle, a titania particle, an alumina particle, a zirconia particle, a zinc oxide particle, a chromium oxide particle, a cerium oxide particle, an antimony oxide particle, a tungsten oxide particle, a tin oxide particle, a tellurium oxide particle, a manganese oxide particle and a boron oxide particle. These external additives may be used singly, or in combinations of two or more.

Besides, for the external additive, organic fine particles may be used, such as homopolymers of styrene or methyl methacrylate, or copolymers thereof.

In order to further improve cleaning properties and transfer properties, lubricants can also be used as the external additive. Examples of the lubricant include metal salts of higher fatty acids including: salts of stearic acid such as zinc, aluminum, copper, magnesium or calcium stearate; salts of oleic acid such as zinc, manganese, iron, copper or magnesium oleate; salts of palmitic acid such as zinc, copper, magnesium or calcium palmitate; salts of linoleic acid such as zinc or calcium linoleate; and salts of ricinoleic acid such as zinc or calcium ricinoleate.

The amount of these external additives to be added is preferably 0.1 to 10 mass % and more preferably 1 to 5 mass % relative to the entire toner particles.

A method of adding the external additive to the toner mother particle is not especially limited. Examples of the method of adding the external additive to the toner mother particle can include a dry method in which the external additive is added as a powder to the toner mother particle that has been dried and the resultant is mixed. As a mixing apparatus for the external additive, various known mixing apparatuses can be used, such as a turbula mixer, a Henschel mixer, a Nauta mixer and a V-shape rotating mixer. For example, when the Henschel mixer is used, the circumferential speed of the tip of a stirring blade is preferably set at 30 to 80 m/s, and stirring and mixing is carried out at 20 to 50° C. for about 10 to 30 minutes.

The charge control agent is not especially limited as long as it is a substance that can impart positive or negative charge by frictional electrification, and various known positive charge control agents and negative charge control agents can be used. The content of the charge control agent is preferably 0.01 to 30 parts by mass and more preferably 0.1 to 10 parts by mass relative to 100 parts by mass of the resin.

For the magnetic material, various known magnetic materials can be used. Examples of the magnetic material include ferromagnetic metals such as iron, nickel and cobalt; alloys including these ferromagnetic metals; compounds of ferromagnetic metals such as ferrite and magnetite; and alloys that do not include ferromagnetic metals, but exhibit ferromagnetism through a heat treatment. Examples of the alloy that exhibits ferromagnetism through a heat treatment include Heusler alloys such as manganese-copper-aluminum and manganese-copper-tin, and chromium dioxide.

The particle size of the toner mother particle is preferably small for the purpose of improving image quality, but the number average particle size of the toner mother particle is preferably in the range of 2 to 8 μm because electrostatic properties, flowability and adhesive properties can be made suitable, and in turn, development, transferal and cleaning are not difficult. It is noted that the particle size of the toner mother particle is further preferably in the range of 4 to 7 μm from the viewpoint described above.

The volume-based median diameter (D50) of the toner particle can be measured and calculated by using an apparatus composed of "Multisizer 3 (manufactured by Beckman Coulter, Inc.)" with a computer system for data processing connected thereto. In the measurement procedure, 0.02 g of the toner particle is thoroughly blended in 20 ml of a surfactant solution (a surfactant solution for dispersing the toner particle, formed by, for example, diluting a neutral detergent containing a surfactant component with pure water by 10 times), and the resultant solution is then subjected to ultrasonic dispersion for 1 minute to prepare a toner particle dispersion. This toner particle dispersion is injected with a pipette to a beaker in a sample stand having ISOTON II placed therein (manufactured by Beckman Coulter, Inc.) until the measured concentration reaches 5 to 10%, and the measurement is carried out by setting the measuring instrument count at 25,000. It is noted that the aperture diameter of the Multisizer 3 used is 100 μm. The measurement range of 1 to 30 μm is divided into 256 parts and their frequencies are calculated, and the particle size at 50% from the part with a bigger volume cumulative fraction is defined as a volume-based median diameter (D50).

The average circularity of the toner mother particle is preferably 0.945 or more because it is better that the shape of the toner mother particle is closer to a spherical shape from the viewpoint of charge buildup and flowability.

The circularity of the toner mother particle is measured by wetting the toner particle with a surfactant aqueous solution, subjecting the resultant solution to ultrasonic dispersion for 1 minute for dispersion, and then using a flow type particle image analyzing apparatus "FPIA-3000" (manufactured by Sysmex Corporation) to carry out the measurement in HPF (High Power Field) mode under measurement conditions with a HPF detected number of 3,000 to 10,000 in an appropriate concentration. Within this range, a measured value can be obtained with reproducibility. The circularity is calculated according to the following formula.

Circularity=(the circumference of a circle having the same projected area as the particle image)/(the circumference of the particle projection image)

Besides, the average circularity is an arithmetic mean value obtained by summing up circularities of particles and dividing the resultant with the number of all particles measured.

[Developer]

A developer can be produced by mixing the toner particle and a carrier particle using a mixing apparatus. Examples of the mixing apparatus include a Henschel mixer, a Nauta mixer and a V-shape rotating mixer. The ratio of the toner particle to the total of the carrier particle and the toner particle (the toner concentration) is preferably 4.0 to 8.0 mass %. When the ratio of the toner particle is 4.0 to 8.0 mass %, the amount of the toner to be charged is made appropriate, and the image quality at an initial stage and after continuous printing becomes more satisfactory.

[Step of Forming Resin Layer on Recording Medium]

The step of forming a resin layer on a recording medium is not especially limited as long as a resin layer can be formed on the recording medium described above. The step of forming a resin layer on a recording medium may be performed before or after the step of supplying a powder onto the recording medium, which will be mentioned later.

The resin layer can be formed on the recording medium by any of known image forming methods such as a dry or wet electrophotographic method and an inkjet method. In particular, the resin layer is preferably a layer including a toner image formed by the electrophotographic method, and preferably contains a toner particle fixed on the recording medium.

[Step of Supplying Powder onto Recording Medium]

The step of supplying a powder onto a recording medium is not especially limited as long as a powder can be supplied onto the recording medium described above. The step of supplying a powder onto a recording medium may be performed before or after the step of forming a resin layer on the recording medium.

When the step of supplying a powder onto a recording medium is performed after the step of forming a resin layer on the recording medium, it is preferable to allow the powder to adhere to the softened resin layer. In this case, from the viewpoint that a variety of decorated images are formed by combining toner images and powders, the toner particles can be, for example, a plurality of types of toner particles different in color provided by a colorant contained therein, or a plurality of types of toner particles different in thermal characteristics. Examples of the toner particle include a black toner particle, a white toner particle, a clear toner particle, a cyan toner particle, a yellow toner particle and a magenta toner particle.

Besides, when the step of supplying a powder onto a recording medium is performed after the step of forming a resin layer on the recording medium, a lower limit of the amount of toner to be adhered is preferably, for example, 0.5 $g/m^2$ or more from the viewpoint of causing the powder to adhere to the softened resin layer, and an upper limit of the amount of toner to be adhered is preferably 15.0 $g/m^2$ or less and further preferably less than 10.0 $g/m^2$.

When the step of supplying a powder onto a recording medium is performed before the step of forming a resin layer on the recording medium, the powder is fixed on the recording medium because the resin layer is formed on the powder. In this case, from the viewpoint of further exhibiting the decoration effect owing to the powder, the toner particle preferably has high optical transparency. When a metallic image retaining a color tone of the powder is desired to be obtained, a clear toner is preferably selected, and when a metallic image with a color tone of the powder adjusted is desired to be obtained, a color toner with a desired color tone is preferably selected from a cyan toner, a magenta toner, a yellow toner and the like. Besides, a mixture of a plurality of types of toners can be used.

An amount of a toner to be adhered in supplying the resin layer on the powder is preferably 0.5 $g/m^2$ or more from the viewpoint of fixing the powder, and is preferably 15.0 $g/m^2$ or less, and more preferably less than 10.0 $g/m^2$ from the viewpoint of inhibiting light scattering and light absorption by the toner to obtain a metallically decorated image.

[Step of Softening Resin Layer]

The image forming method according to the present embodiment may include a step of softening a resin layer. Examples of a method of softening a resin layer include heating the resin layer, adding a softener to the resin layer, and using the heating and the addition of a softener in combination, but are not limited to these methods. In particular, the method of softening a resin layer is preferably heating from the viewpoint that the powder is unlikely to be detached. The step of softening a resin layer may be performed after, before or simultaneously with the step of supplying a powder onto the surface of the resin layer.

The heating is not especially limited as long as the resin layer can be softened. The heating is performed such that the temperature of the recording medium can be lower than a temperature at which the recording medium is deformed, or such that the temperature of the powder can be lower than a temperature at which the powder is degraded, changed in color or deformed. The heating may be performed after the supply of the powder, before the supply of the powder, or simultaneously with the supply of the powder. The heating is performed by heating the recording medium from a side of the rear surface thereof using, for example, a hot plate, by photothermal conversion, or by photoisomerization.

The heating may be performed after the supply of the powder, before the supply of the powder, or simultaneously with the supply of the powder.

The heating temperature is not especially limited as long as the resin layer is softened, and may be arbitrarily adjusted in accordance with a desired decoration effect, and may be adjusted to an extent where the resin layer is sufficiently softened or to an extent where the resin layer starts to have adhesive ability. The heating temperature is preferably, for example, 90° C. to 170° C. Besides, the heating temperature is preferably a temperature at which the storage modulus G' of the resin layer is $1.0\times10^1$ to $1.0\times10^6$ Pa.

The softener is not especially limited as long as it can soften the resin layer. Examples of the softener include an organic solvent, alcohols, ketones, esters, ethers and a solution containing any of these, and specific examples include isobutyl adipate, tetrahydrofuran and a solution containing any of these. When the softener is added to the surface of the resin layer, the resin contained in the resin layer is partially dissolved or swollen, which is probably the reason why the resin layer is softened.

The addition of the softener is not especially limited as long as the softener can be added to the surface of the resin layer. Examples of a method for adding the softener include spray coating, an inkjet method and a coating method using a dispenser. The softener may be added before the supply of the powder, after the supply of the powder, or simultaneously with the supply of the powder. An amount of the softener to be added is not especially limited, and may be arbitrarily adjusted in accordance with the resin layer, the powder, a desired decoration effect and the like, and the softener may be added to an extent where the resin layer is sufficiently softened, or to an extent where the resin layer starts to have adhesive ability.

The softener may be adjusted to have a desired film thickness before the supply. The film thickness of the supplied softener is, for example, preferably 0.1 μm to 10 μm, more preferably 0.5 μm to 5 μm, and further preferably 1 μm to 3 μm.

[Step of Supplying Powder onto Surface of Resin Layer]

The image forming method according to the present embodiment may include a step of supplying a powder onto the surface of the resin layer.

[Powder]

A powder is supplied onto the surface of a resin layer, and a decoration effect is exhibited in accordance with the resin layer and the powder. The powder is an aggregation of powder particles. Examples of the powder particle include a metal particle, a resin particle, a particle containing a thermoresponsive material, a magnetic particle and a non-magnetic particle. For example, when a metallic decoration effect is desired to be obtained, the powder preferably contains a metal particle. Besides, the powder particle may contain two or more different materials. The powder particle may be in the shape of a spherical particle or a non-spherical particle. The powder may be a synthetic product or a commercially available product. The powder may be a mixture of two or more different powder particles. It is noted that the powder is not a toner.

The arithmetic mean height Sa of the non-spherical powder can be obtained by calculating the value of arithmetic mean height Sa of the surface using VK-X200 Series (manufactured by Keyence Corporation). An image of the targeted powder is obtained using a 150× objective lens. Correction of surface inclination is carried out on the basis of one particle. A region of 10 μm×10 μm in the particle that has been subjected to the inclination correction is selected and the arithmetic mean height Sa of the surface is measured. It is noted that the region to be measured can be modified appropriately depending on the size of a particle.

In powders ranging from those having almost smooth surface properties to those having considerable irregularities, arithmetic mean heights Sa's of their surfaces vary. However, the arithmetic mean height Sa of the surface of the powder particle is preferably 8 nm or more and 250 nm or less.

When the arithmetic mean height Sa of the surface of the powder particle is 8 nm or more, the surface area of the powder particle is increased and the contact area with the resin layer softened by heating is increased, and therefore, adhesive properties of the powder particle can be enhanced more. When the arithmetic mean height Sa of the surface of the powder particle is 250 nm or less, the resin softened by heating can readily enter the inside of irregularities on the surface of the powder particle, and a broader range out of the surface of the powder particle can be contacted with the resin layer, thereby further enhancing adhesive properties of the powder particle. The arithmetic mean height Sa of the surface of the powder particle is more preferably 10 nm or more and 200 nm or less.

The metal particle is not especially limited as long as it is a particle containing a metal and/or a metal oxide. The metal particle may be coated. For example, the metal particle may be coated with a different metal, a metal oxide or a resin, or the surface of a resin, glass or the like may be coated with a metal or a metal oxide. Besides, a metal particle may be a metal oxide particle, or may be a metal oxide particle coated with a different metal oxide, a metal or a resin. Alternatively, the metal particle may be a particle obtained by extending a metal or a metal oxide into a plate shape and pulverizing the resultant, or such a particle coated with any of various materials, or a film or glass on which a metal or a metal oxide is deposited or wet coated. In order to obtain a metallic image, the metal particle preferably contains a metal or a metal oxide, and a content of the metal or the metal oxide is preferably 0.2 wt % to 100 wt %.

The non-spherical particle is a particle different from a spherical particle. The spherical particle is a particle with a cross-sectional shape or a projected shape having an average circularity of 0.970 or more. It is noted that the average circularity can be obtained by a known method, or may be a catalog value.

From the viewpoint of aligning the powder particle along the surface of the resin layer, the non-spherical particle is preferably a flat particle having a flat particle shape. The term "flat particle shape" of the non-spherical particle means a shape having a ratio of a short diameter to a thickness (short diameter/thickness) of 5 or more, assuming that a maximum length of the non-spherical particle corresponds to a long diameter, that a maximum length in a perpendicular direction to the long diameter corresponds to the short diameter, and that a minimum length in a direction perpendicular to both the long diameter and the short diameter corresponds to a thickness.

From the viewpoint of aligning the powder particle against the surface of the recording medium, the flat particle shape has a long diameter of preferably 10 μm or more and 100 μm or less, and a short diameter of preferably 10 μm or more and 100 μm or less.

The flat particle shape has a thickness of preferably 0.2 μm or more and 3.0 μm or less, and more preferably 1.0 μm or more and 2.0 μm or less. When the thickness of the flat particle shape is 0.2 μm or more, the powder aligned along the surface of the resin layer can easily provide a desired appearance. When the thickness of the flat particle shape is 3.0 μm or less, the powder is difficult to peel off when the resultant image is rubbed.

The long diameter, the short diameter and the thickness of the powder particle are measured using a scanning electron microscope as follows. A powder particle is caused to adhere to a carbon tape to have a large contact area, and the resultant is used as a measurement sample. The long diameter and the short diameter are measured by observing the powder particle with the scanning electron microscope from directly above the surface of the carbon tape. On the other hand, the thickness is measured by observing the powder particle with the scanning electron microscope from a lateral direction to the surface of the carbon tape.

Examples of the non-spherical particle include Sunshine Babe, Chrome Powder, Aurora Powder and Pearl Powder (all manufactured by GG Corporation Inc.), ICEGEL Mirror Metal Powder (manufactured by TAT Inc.), Pica Ace MC Shine Dust and Effect C (manufactured by Kabushiki Kaisha Kurachi, "Pica Ace" being their registered trademark), PREGEL Magic Powder, Mirror Series (manufactured by Yugen Kaisha Preanfa, "PREGEL" being their registered trademark), BONNAIL Shine Powder (manufactured by K's Planning Co., Ltd., "BONNAIL" being their registered trademark), MetaShine (manufactured by Nippon Sheet Glass Co., Ltd., their registered trademark), ELgee neo (manufactured by Oike & Co., Ltd., their registered trademark), Astroflake (manufactured by Nihonboshitsu Co., Ltd., registered trademark of Hajime Okazaki), and Aluminum Pigment (manufactured by Toyo Aluminum K.K.). Besides, examples of the spherical powder include High-Precision UNIBEADS (manufactured by UNITIKA LTD.) and Fine Spheres (manufactured by Nippon Electric Glass Co., Ltd., "Fine Spheres" being their registered trademark).

The thermoresponsive material is a material that is changed, by thermal stimulation, in shape such as expansion, shrinkage or deformation, or in color such as color development, decolorization or discoloration. Examples of the particle containing a thermoresponsive material include a thermally expandable microcapsule and a temperature-sensitive capsule. Examples of the thermally expandable microcapsule include Matsumoto Microsphere (manufactured by Matsumoto Yushi-Seiyaku Co., Ltd.) and Kureha Microsphere (manufactured by Kureha Corporation), and an example of the temperature-sensitive capsule includes a temperature-sensitive dye capsule (manufactured by Japan Capsular Products Inc.).

The powder can be supplied by any known means, and for example, the powder supplying means described in Japanese Patent Application Laid-Open No. 2013-178452 can be used.

[Step of Aligning Powder Supplied onto Surface of Resin Layer]

The image forming method according to the present embodiment may include a step of aligning a powder supplied onto the surface of a resin layer.

Figure 1B:
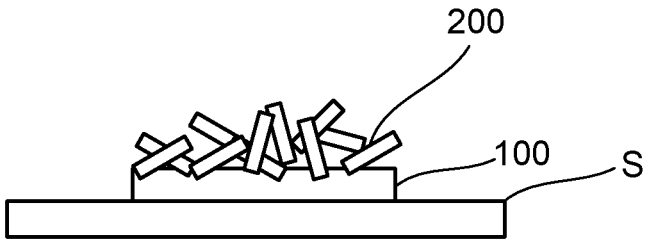
FIG. 1B is a schematic diagram illustrating a state where a powder is supplied onto a softened resin layer.

Using FIG. 1A to FIG. 1E, one example of the aligning will be described. FIG. 1A is a schematic diagram illustrating resin image 110 including recording medium S and resin layer 100 disposed thereon. FIG. 1B is a schematic diagram illustrating a state where resin layer 100 in the state of FIG. 1A is softened, and a powder is supplied thereonto. As illustrated in FIG. 1B, directions of powder particles 200 are random in a state where the powder has just been supplied.

Figure 1C:
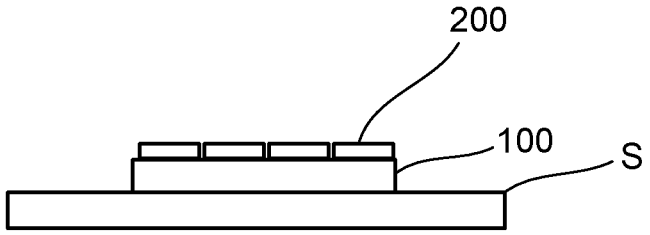
FIG. 1C is a schematic diagram illustrating a state where a decorated image is obtained by aligning powder particles.

FIG. 1C is a schematic diagram illustrating a state where powder particles 200 are aligned from the state of FIG. 1B by, for example, rubbing and a decorated image is obtained. As illustrated in FIG. 1C, when powder particles 200 are aligned by rubbing, extra powder particles 200 are removed and directions of powder particles 200 become uniform against the surface of the resin layer, and due to this, a decorated image is obtained. In the state of FIG. 1C, if powder particles 200 are metal particles, the decorated image to be obtained is, for example, a mirror-like image or a pearl-like image.

Figure 1D:
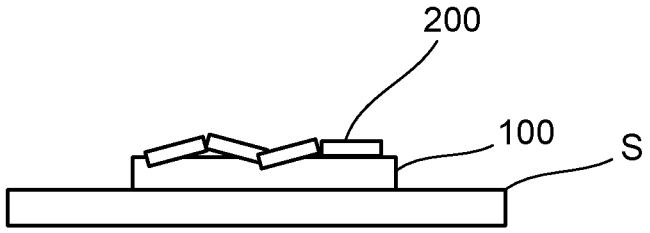
FIG. 1D is a schematic diagram illustrating another state where a decorated image is obtained by aligning powder particles.

FIG. 1D is a schematic diagram illustrating another state where powder particles 200 are aligned from the state of FIG. 1B by, for example, rubbing and a decorated image is obtained. The state of FIG. 1D is a state where, for example, the resin layer is softer compared to that in FIG. 1C, and some of the powder particles are buried in the resin layer. In the state of FIG. 1D, if powder particles 200 are metal particles, the decorated image to be obtained is, for example, a mirror-like image or an image having a pearl-like glittering effect.

Figure 1E:
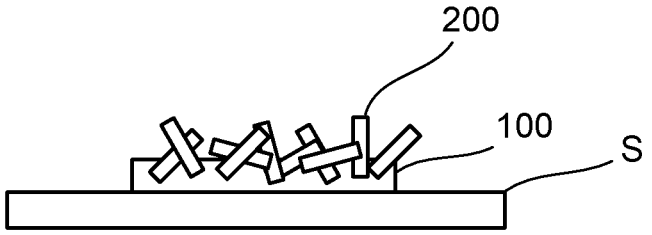
FIG. 1E is a schematic diagram illustrating another state where a decorated image is obtained by aligning powder particles.

FIG. 1E is a schematic diagram illustrating another state where powder particles 200 are aligned from the state of FIG. 1B by, for example, rubbing and a decorated image is obtained. The state of FIG. 1E is a state where, for example, the resin layer is softer compared to that in FIG. 1C, and more powder particles are buried in the resin layer. In the state of FIG. 1E, if powder particles 200 are metal particles, the decorated image to be obtained is, for example, an image having a glittering effect.

The alignment is a step of aligning the direction of the supplied powder in accordance with the surface of the resin layer, and the step is not especially limited as long as the direction of the powder can be aligned in accordance with the surface of the resin layer at least to some extent. The alignment can be performed, for example, by rubbing, by blowing toward the surface of the resin layer onto which the powder has been supplied, or if the powder contains a magnetic particle, by attracting the powder from the rear surface of the recording medium with a magnetic force.

The rubbing means that a rubbing member in contact with the surface of the resin layer onto which the powder has been supplied is moved relatively to the surface. From the viewpoint of aligning the powder on the surface of the resin layer, and from the viewpoint of enhancing adhesion of the powder to the resin layer, the rubbing is performed preferably under pressing. The term "pressing" means pressing the surface of the resin layer in a direction crossing the surface of the resin layer (for example, in the vertical direction).

In the rubbing, when a rubbing speed is too low, the powder may be insufficiently aligned in accordance with the surface of the resin layer, and when the rubbing speed is too high, the adhesion of the powder may be so insufficient that the alignment of the powder in accordance with the surface of the resin layer may be insufficient, and hence, desired appearance clarity of a final image may be degraded in some cases. From the viewpoint of attaining sufficient adhesion and alignment of the powder on the surface of the resin layer, a relative speed difference of the rubbing member relative to the surface of the resin layer is preferably 5 mm/sec to 500 mm/sec, and more preferably 70 mm/sec to 130 mm/sec.

In the rubbing, when a contact width of the rubbing member against the surface of the resin layer is too small, the direction of the powder is easily varied in moving the rubbing member along the surface of the resin layer, and hence the alignment of the powder adhering to the resin layer may be insufficient in some cases, and when the contact width is too large, the recording medium is difficult to convey. From the viewpoint of sufficiently realizing a desired aligning property of the powder adhering to the surface of the resin layer and a conveying property of the recording medium, the contact width is preferably 1 mm to 200 mm in terms of a length in the moving direction of the rubbing member against the resin layer.

In the rubbing, when a pressing force is too small, the adhesion strength of the powder may be weakened in some cases, and when the pressing force is too large, the resin layer itself may be disturbed, and a torque in conveying the resin image may be increased in some cases. From the viewpoint of smoothly conveying the resin image with labor saved, from the viewpoint of retaining the image formed on the resin layer, and from the viewpoint of increasing the adhesion strength of the powder, the pressing force is preferably 1 to 30 kPa, and more preferably 7 to 13 kPa against the surface of the resin layer.

The rubbing member may be configured to be movable in a direction relatively different from the resin layer while pressing the surface of the resin layer.

The rubbing member may be a rotating member, or may be a non-rotating member such as a reciprocating member or a fixed member. The rubbing member may be a member that is in contact with the substantially horizontal surface of the resin layer and is movable relatively to the surface in a horizontal direction, a member that is in contact with the substantially horizontal surface of the resin layer and is relatively rotatable around a rotation axis along a direction vertical to the surface, or a rotatable roller in contact with the surface of the resin layer.

The rubbing member is configured to have its surface movable relatively to the surface of the resin layer while pressing the resin layer. The rubbing by the rubbing member can be performed, for example, by rubbing with a fixed rubbing member during conveyance of the recording medium having the resin layer formed thereon, by rubbing with a roller rotated at a speed lower than a conveyance speed during the conveyance, by rubbing with a roller rotated in a direction reverse to the conveyance direction during the conveyance, by rubbing with a rotatable roller disposed to have its rotation axis inclined against the conveyance direction, by rubbing with a member reciprocating on the surface of the recording medium having the resin layer formed thereon, or by rubbing with a member rotating around a rotation axis along the direction vertical to the surface of the recording medium having the resin layer formed thereon.

The rubbing member is preferably flexible. The flexibility of the rubbing member is, for example, softness (property to follow deformation) to an extent where the surface of the rubbing member is deformed to be able to follow the shape of the surface of the resin layer when pressed. Examples of the rubbing member having such flexibility include a sponge and a brush.

[Image Forming Apparatus]

Figure 2:
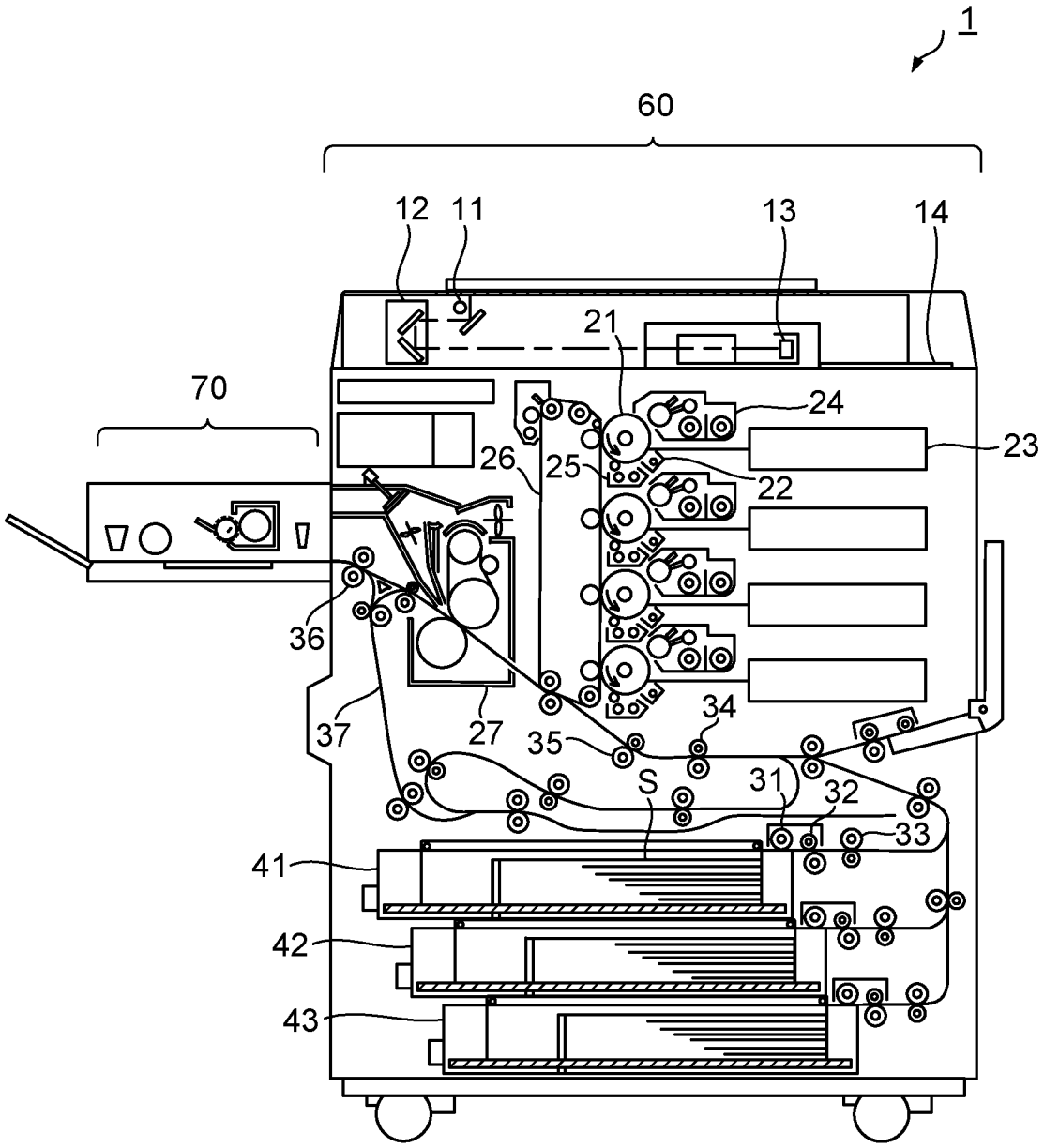
FIG. 2 is a schematic diagram of a structure of an image forming apparatus according to one embodiment of the present invention.

An image forming apparatus according to another embodiment of the present invention will be described with reference to FIG. 2. Image forming apparatus 1 includes, as illustrated in FIG. 2, resin image forming section 60 and surface treating section 70. Resin image forming section 60 is a part for forming a resin image including a recording medium and a resin layer disposed thereon. Surface treating section 70 is a part for treating the surface of the resin image formed by resin image forming section 60 for decoration.

Resin image forming section 60 has a structure similar to that of a known color printer. Resin image forming section 60 includes an image reading section, an image forming section, a sheet conveying section, a sheet feeding section, a data receiving section, a control section and fixing section 27.

The image reading section includes light source 11, optical system 12, imaging device 13 and image processing section 14.

The image forming section includes an image forming section for forming an image of a yellow (Y) toner, an image forming section for forming an image of a magenta (M) toner, an image forming section for forming an image of a cyan (C) toner, an image forming section for forming an image of a black (K) toner, and intermediate transfer belt 26. It is noted that Y, M, C and K corresponds to the colors of toners.

The image forming section includes a rotating member of photoconductor drum 21, and charging section 22, optical writing section 23, developing device 24 and drum cleaner 25 disposed around the photoconductor drum. Intermediate transfer belt 26 is wound around a plurality of rollers to be movably supported.

The sheet conveying section includes feed roller 31, separation roller 32, conveyance roller 33, loop roller 34, registration roller 35, sheet ejection roller 36 and sheet inverting section 37. The sheet feeding section includes a plurality of sheet feed trays 41, 42 and 43 each holding recording media S therein.

The control section includes a CPU (Central Processing Unit), a RAM (Random Access Memory) and a ROM (Read Only Memory). The CPU controls, in accordance with programs stored in the ROM, the image reading section, the image forming section, the sheet conveying section, the sheet feeding section and the surface treating section, and stores operation results and the like in the RAM. Besides, the control section performs control to analyze print data externally received to generate image data in a bit map format, and to form an image based on the image data on recording medium S. The programs include a program for adjusting the amount of a softener to be supplied and a program for setting rubbing conditions in the surface treating section.

Besides, the control section transmits/receives, through a communication section not shown, various data to/from an external apparatus (such as a personal computer) connected to a communication network such as a LAN (Local Area Network) or WAN (Wide Area Network). The control section receives, for example, image data transmitted from an external apparatus, or input data on a decorated image to be formed received by the data receiving section, and allows an image to be formed on recording medium S based on this image data (input image data). The communication section is constituted by a communication control card such as a LAN card.

The resin image formed by resin image forming section 60 is conveyed to surface treating section 70 to be decorated.

Figure 3:
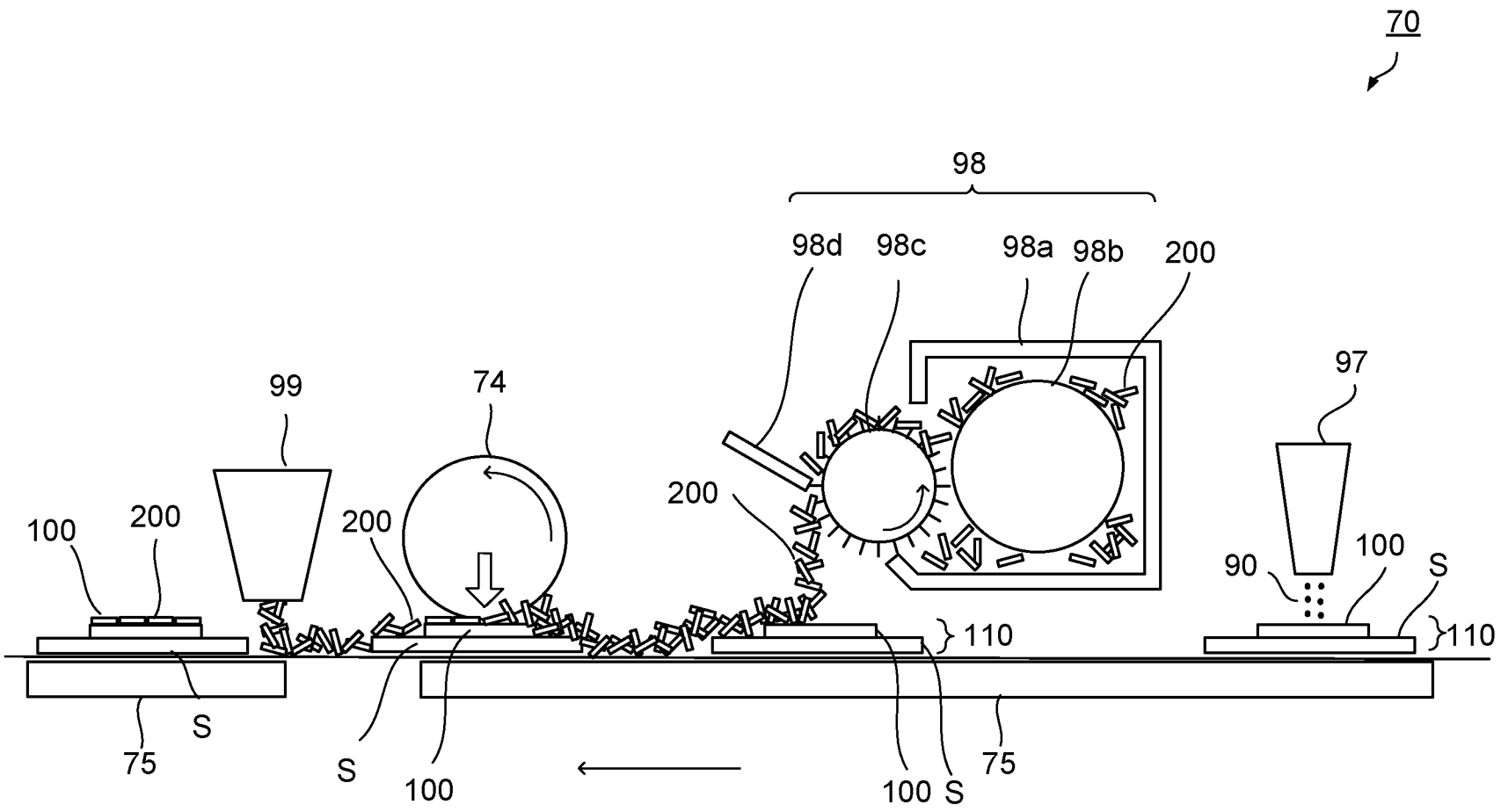
FIG. 3 is a schematic diagram of a structure of a surface treating section of the image forming apparatus according to one embodiment of the present invention.

As illustrated in FIG. 3, surface treating section 70 includes softener supply section 97 as a softener supplying means, powder supply section 98 as a powder supplying means, rubbing roller 74, heater 75 and powder collecting section 99.

Heater 75 is provided in a position in front of softener supply section 97, a position opposing softener supply section 97, a position opposing powder supply section 98, a position opposing rubbing roller 74, a position after rubbing roller 74, or the like. Heater 75 is, for example, a hot plate. Heater 75 may be used for various purposes of softening the resin layer by heating, increasing a process speed, heating a thermoresponsive material supplied onto the surface of the resin image, and the like in a range with consideration for the heat resistances of the recording medium and the powder.

Softener supply section 97 supplies softener 90 to the surface of resin image 110 including recording medium S and resin layer 100 disposed thereon. The softener supply section is not especially limited as long as the softener can be supplied. Examples of the softener supply section include a spray, an inkjet and a dispenser.

Powder supply section 98 supplies a powder to resin image 110. The powder supplying means may be any known means, and for example, the powder supplying means described in Japanese Patent Application Laid-Open No. 2013-178452 can be used.

Powder supply section 98 includes vessel 98*a* for holding powder particle 200 therein, conveyance screw 98*b* for conveying powder particle 200 to an opening of vessel 98*a*, brush roller 98*c* for taking powder particle 200 out of vessel 98*a* and flicker 98*d* for flicking off powder particle 200 held on brush roller 98*c*. Powder particle 200 is a non-spherical powder having, for example, the flat particle shape described above.

The opening of vessel 98*a* is formed in a size coming into contact with a tip of a brush of brush roller 98*c* to restrict the amount of powder particles 200 held on brush roller 98*c*. Flicker 98*d* is a plate-shaped member, and is disposed in a position in contact with brush roller 98*c*. Intrusion of brush roller 98*c* into flicker 98*d* can be determined in consideration of, for example, the amount of powder particle 200 to be supplied and uneven wear of the brush, and the length and the density of brush hairs of brush roller 98*c* can be determined in consideration of, for example, the amount of powder particle 200 to be supplied and burping of powder particle 200.

Flicker 98*d* may be fixed in a position in contact with brush roller 98*c*, or flicker 98*d* may be constructed to be movable so that flicker 98*d* can be moved away from brush roller 98*c* during a stop of brush roller 98*c*.

Rubbing roller 74 corresponding to a rubbing member has a rotation axis vertical to the conveyance direction of recording medium S and vertical to the sheet surface, and is constructed to be rotatable in a direction indicated by an arrow in the drawing, and constructed to be biased by a biasing member (not shown). Rubbing roller 74 includes, for example, a cylindrical core metal, and an elastic layer disposed on the outer peripheral surface of the core metal and made of a resin sponge or the like. The axial length of rubbing roller 74 is longer than the width of recording medium S.

Although the rubbing member is illustrated as rubbing roller 74 in FIG. 3, the rubbing member is not especially limited as long as it can perform the rubbing, and may be a reciprocating member, a member rotating around a rotation axis along the direction vertical to the surface of the resin image, or a fixed member.

Powder collecting section 99 is, for example, a dust collector for sucking an excessive portion of powder particles 200 out of all powder 200 supplied from powder supply section 98. The dust collector is disposed to have a suction port thereof opened at an appropriate height from a conveyance path of recording medium S, and is configured to be operated at an appropriate output level, for example, for sucking powder 200 but not sucking recording medium S.

It is noted that an image forming apparatus used in embodiments having the step of supplying a powder before the step of forming a resin layer includes an apparatus for supplying a powder before a resin image forming section.

EXAMPLES

Now, specific Examples of the embodiments will be described together with Comparative Examples. It is noted that the technical scope of the present invention is not limited to the following Examples alone.

1. Preparation of Developer

A resin layer of the present embodiment was formed by outputting it onto a recording medium using a remodeled machine of "AccurioPress C2060" (manufactured by Konica Minolta, Inc., "AccurioPress" being their registered trademark) loaded with a developer. Dispersions of vinyl resin particles for the core particle 1 to 4, dispersion of crystalline polyester resin particles C1, a dispersion of coloring particles, and dispersions of amorphous polyester resin particles for the shell layer S1 and S2, all of which were to be used for preparing the developer, were prepared as follows.

[Preparation of Dispersion of Vinyl Resin Particles for Core Particle 1]

(First Stage Polymerization)

In a 5-liter reaction vessel equipped with a stirrer, a temperature sensor, a condenser and a nitrogen-introducing device, 8 parts by mass of sodium lauryl sulfate and 3,000 parts by mass of ion-exchanged water were placed, and the internal temperature was increased to 80° C. under nitrogen stream with stirring at a stirring speed of 230 rpm. After increasing the temperature, a solution prepared by dissolving 10 parts by mass of potassium persulfate in 200 parts by mass of ion-exchanged water was added, and the temperature of the resultant solution was raised to 80° C. again, and then, a mixture of the following monomers was added in a dropwise manner over 1 hour.

styrene: 480.0 parts by mass n-butyl acrylate: 250.0 parts by mass methacrylic acid: 68.0 parts by mass After the dropwise addition of the mixture, polymerization of monomers was performed by heating and stirring the resultant at 80° C. for 2 hours, and thus, dispersion of vinyl resin particles (1-a) was prepared.

(Second Stage Polymerization)

In a 5-liter reaction vessel equipped with a stirrer, a temperature sensor, a condenser and a nitrogen-introducing device, a solution obtained by dissolving 7 parts by mass of sodium polyoxyethylene (2) dodecyl ether sulfate in 3,000 parts by mass of ion-exchanged water was placed, and was heated to 98° C. After the heating, 80 parts by mass of dispersion of vinyl resin particles (1-a), which was prepared in the first stage polymerization described above, in terms of solid content, and a mixture in which the following monomers, a chain transfer agent and a release agent were dissolved at 90° C. were added.

styrene: 285.0 parts by mass n-butyl acrylate: 95.0 parts by mass methacrylic acid: 20.0 parts by mass n-octyl-3-mercaptopropionate (chain transfer agent): 1.5 parts by mass behenyl behenate (release agent, melting point: 73° C.): 151.0 parts by mass With a mechanical dispersion apparatus "Clearmix" (R) (manufactured by M Technique Co., Ltd.) having a circulation path, a mixing and dispersing treatment was carried out for 1 hour to prepare a dispersion containing emulsified particles (oil droplets). To this dispersion, a polymerization initiator solution obtained by dissolving 6 parts by mass of potassium persulfate in 200 parts by mass of ion-exchanged water was added, and this system was subjected to heating and stirring at 84° C. over 1 hour for polymerization, thereby preparing dispersion of vinyl resin particles (1-b).

(Third Stage Polymerization)

To dispersion of vinyl resin particles (1-b) obtained by the second stage polymerization described above, 400 parts by mass of ion-exchanged water was further added and mixed well, and subsequently, a solution obtained by dissolving 11 parts by mass of potassium persulfate in 400 parts by mass of ion-exchanged water was added. Furthermore, a mixture containing the following monomers and a chain transfer agent was added in a dropwise manner at 82° C. over 1 hour.

styrene: 454.8 parts by mass 2-ethylhexyl acrylate: 143.2 parts by mass methacrylic acid: 52.0 parts by mass n-octyl-3-mercaptopropionate: 8.0 parts by mass After completing the dropwise addition, polymerization was carried out by heating and stirring over 2 hours, and the resultant solution was then cooled to 28° C. to prepare dispersion of vinyl resin particles for the core particle 1. The weight average molecular weight (Mw) of vinyl resin 1 in that dispersion was found to be 30,000. Besides, the vinyl resin particles in the dispersion were found to have a volume-based median diameter of 235 nm.

[Preparation of Dispersion of Vinyl Resin Particles for Core Particle 2]

Dispersion of vinyl resin particles (2-b) was prepared in the same manner as in dispersion of vinyl resin particles (1-b) except that the amount of behenyl behenate was changed to 190.0 parts by mass, and dispersion of vinyl resin particles for the core 2 was prepared. The weight average molecular weight (Mw) of vinyl resin 2 in that dispersion was found to be 31,000. Besides, the vinyl resin particles in that dispersion were found to have a volume-based median diameter of 230 nm.

[Preparation of Dispersion of Vinyl Resin Particles for Core Particle 3]

Dispersion of vinyl resin particles for the core 3 was prepared in the same manner as described above except that the amount of n-octyl-3-mercaptopropionate (chain transfer agent) was changed to 0.75 parts by mass and the amount of behenyl behenate was changed to 88.0 parts by mass in dispersion of vinyl resin particles (1-b), and the amount of n-octyl-3-mercaptopropionate (chain transfer agent) was changed to 4.0 parts by mass in dispersion of vinyl resin particles for the core particle 1. The weight average molecular weight (Mw) of vinyl resin 3 in that dispersion was found to be 37,000. Besides, the vinyl resin particles in that dispersion were found to have a volume-based median diameter of 240 nm.

[Preparation of Dispersion of Vinyl Resin Particles for Core Particle 4]

Dispersion of vinyl resin particles for the core 4 was prepared in the same manner as described above except that the amount of n-octyl-3-mercaptopropionate (chain transfer agent) was changed to 3.0 parts by mass in dispersion of vinyl resin particles (2-b), and the amount of n-octyl-3-mercaptopropionate (chain transfer agent) was changed to 16.0 parts by mass in dispersion of vinyl resin particles for the core particle 2. The weight average molecular weight (Mw) of vinyl resin 4 in that dispersion was found to be 25,000. Besides, the vinyl resin particles in that dispersion were found to have a volume-based median diameter of 220 nm.

[Synthesis of Crystalline Polyester Resin and Preparation of Dispersion Thereof C1]

(Synthesis of Crystalline Polyester Resin)

The raw material monomers for a styrene-acrylic polymerization segment (StAc) including a bireactive monomer and the radical polymerization initiator described below were placed in a dropping funnel.

styrene: 36.0 parts by mass n-butyl acrylate: 13.0 parts by mass acrylic acid: 2.0 parts by mass di-t-butyl peroxide (polymerization initiator): 7.0 parts by mass Besides, the raw material monomers for a crystalline polyester polymerization segment (CPEs) described below were placed in a four-neck flask equipped with a nitrogen gas-introducing pipe, a dewatering pipe, a stirrer and a thermocouple, and were heated to 170° C. and dissolved.

tetradecanedioic acid: 440 parts by mass 1,4-butanediol: 153 parts by mass

Subsequently, raw material monomers for the styrene-acrylic polymerization segment (StAc) were added in a dropwise manner with stirring over 90 minutes, and after aging for 60 minutes, unreacted raw material monomers were removed under reduced pressure (8 kPa). It is noted that the amount of raw material monomers removed at that time was negligible against the amount of raw material monomers that had been placed. Thereafter, 0.8 parts by mass of titanium tetrabutoxide ($Ti(O\text{-}n\text{-}Bu)_4$) was put as an esterification catalyst, the temperature was increased to 235° C., and the reaction was carried out for 5 hours under normal pressure (101.3 kPa), and furthermore, for 1 hour under reduced pressure (8 kPa).

Subsequently, the resultant mixture was cooled to 200° C., and the reaction was allowed to proceed for 1 hour under reduced pressure (20 kPa) to obtain a crystalline polyester resin (a hybrid crystalline polyester resin). The obtained crystalline polyester resin had an acid number of 20.9, a weight average molecular weight (Mw) of 25,200, a melting point (Tm) of 74.9° C., and a recrystallization temperature (Rc) of 69.7° C.

(Preparation of Dispersion of Crystalline Polyester Resin Particles C1)

In 72 parts by mass of methyl ethyl ketone, 72 parts by mass of the crystalline polyester resin obtained as described above was dissolved by stirring for 30 minutes at 70° C. Next, to the resultant solution, 2.5 parts by mass of a 25 mass % sodium hydroxide aqueous solution was added. The resultant solution was placed in a reaction vessel equipped with a stirrer, and 252 parts by mass of water warmed to 70° C. was added in a dropwise manner and mixed over 70 minutes with stirring. In the middle of the dropwise addition, the solution in the vessel became clouded, and reached a uniformly emulsified state after the dropwise addition of the entire amount.

Subsequently, while maintaining the temperature of this emulsion at 70° C., methyl ethyl ketone was distilled and removed by stirring for 3 hours under reduced pressure of 15 kPa (150 mbar) using a diaphragm type vacuum pump "V-700" (manufactured by BUCHI Labortechnik AG), and aqueous dispersion of the crystalline polyester resin C1 was prepared. As a result of measurement with a particle size distribution measuring apparatus, particles contained in the dispersion described above were found to have a volume average particle size of 220 nm.

[Synthesis of Amorphous Polyester Resin for Shell Layer and Preparation of Dispersion Thereof S1]

(Synthesis of Amorphous Polyester Resin for Shell Layer)

The raw material monomers for a styrene-acrylic polymerization segment (StAc) including a bireactive monomer and the radical polymerization initiator described below were placed in a dropping funnel.

styrene: 80.0 parts by mass n-butyl acrylate: 20.0 parts by mass acrylic acid: 10.0 parts by mass di-t-butyl peroxide (polymerization initiator): 16.0 parts by mass Besides, the raw material monomers for an amorphous polyester polymerization segment (APEs) described below were placed in a four-neck flask equipped with a nitrogen-introducing pipe, a dewatering pipe, a stirrer and a thermocouple, and were heated to 170° C. and dissolved.

bisphenol A propylene oxide 2-mole adduct: 200.0 parts by mass bisphenol A ethylene oxide 2-mole adduct: 85.7 parts by mass terephthalic acid: 66.9 parts by mass fumaric acid: 47.4 parts by mass Under stirring, the mixture placed in the dropping funnel was added in a dropwise manner to the four-neck flask over 90 minutes, and after aging for 60 minutes, unreacted monomers were removed under reduced pressure (8 kPa). Thereafter, 0.4 parts by mass of titanium tetrabutoxide ($Ti(O\text{-}n\text{-}Bu)_4$) was put as an esterification catalyst, the temperature was increased to 235° C., and the reaction was carried out for 5 hours under normal pressure (101.3 kPa), and furthermore, for 1 hour under reduced pressure (8 kPa). Subsequently, the resultant mixture was cooled to 200° C., and the reaction was carried out under reduced pressure (20 kPa). Thereafter, the solvent was removed to obtain amorphous polyester resin for the shell layer s1 (a hybrid amorphous polyester resin). The obtained amorphous polyester resin for the shell layer has a weight average molecular weight (Mw) of 25,000 and a glass transition temperature (Tg) of 60° C.

(Preparation of Dispersion of Amorphous Polyester Resin Particles for Shell Layer S1)

In 72 parts by mass of methyl ethyl ketone, 72 parts by mass of the amorphous polyester resin for the shell layer obtained as described above was dissolved by stirring for 30 minutes at 70° C. Next, to the resultant solution, 3.0 parts by mass of a 25 mass % sodium hydroxide aqueous solution was added. The resultant solution was placed in a reaction vessel equipped with a stirrer, and 252 parts by mass of water warmed to 70° C. was added in a dropwise manner and mixed over 70 minutes with stirring. In the middle of the dropwise addition, the solution in the vessel became clouded, and reached a uniformly emulsified state after the dropwise addition of the entire amount.

Subsequently, while maintaining the temperature of this emulsion at 70° C., methyl ethyl ketone was distilled and removed by stirring for 3 hours under reduced pressure of 15 kPa (150 mbar) using a diaphragm type vacuum pump "V-700" (manufactured by BUCHI Labortechnik AG), and aqueous dispersion of the amorphous polyester resin S1 was prepared. As a result of measurement with the above-described particle size distribution measuring apparatus, particles contained in the dispersion described above were found to have a volume average particle size of 92 nm.

[Synthesis of Styrene-Acrylic Resin for Shell Layer and Preparation of Dispersion Thereof S2]

In a 5-liter reaction vessel equipped with a stirrer, a temperature sensor, a condenser and a nitrogen-introducing device, 5.0 parts by mass of sodium dodecyl sulfate and 2,500 parts by mass of ion-exchanged water were placed, and the internal temperature was increased to 80° C. under nitrogen stream with stirring at a stirring speed of 230 rpm.

Subsequently, an aqueous solution prepared by dissolving 15.0 parts by mass of potassium persulfate (KPS) in 300 parts by mass of ion-exchanged water was added, and the temperature of the resultant solution was raised to 80° C. again. Thereafter, a monomer mixture containing 840.0 parts by mass of styrene (St), 288.0 parts by mass of n-butyl acrylate (BA), 72.0 parts by mass of methacrylic acid (MAA) and 15 parts by mass of n-octyl mercaptan was added in a dropwise manner over 2 hours. After completing the dropwise addition, polymerization was carried out by heating and stirring the resultant reaction solution at 80° C. for 2 hours, and thus, dispersion of styrene-acrylic resin particles S2 was prepared. As a result of measurement with the above-described particle size distribution measuring apparatus, particles contained in the dispersion described above were found to have a volume average particle size of 110 nm.

[Preparation of Dispersion of Colorant Particles]

While stirring a solution obtained by adding 90 parts by mass of sodium lauryl sulfate to 1,600 parts by mass of ion-exchanged water, 420 parts by mass of copper phthalocyanine (C.I. Pigment Blue 15:3) was gradually added. By carrying out a dispersion treatment using a stirrer "Clearmix" (R) (manufactured by M Technique Co., Ltd.), a dispersion of colorant particles was prepared. The colorant particles in that dispersion were found to have a volume-based median diameter of 110 nm.

[Production of Toner 1]

In a reaction vessel equipped with a stirrer, a temperature sensor and a condenser, 321 parts by mass of dispersion of vinyl resin particles for the core particle 1 (in terms of solid content), 1 mass % of sodium salt of dodecyl diphenyl ether disulfonic acid in the resin ratio (in terms of solid content), and 2,000 parts by mass of ion-exchanged water were put. At room temperature (25° C.), a 5 mol/L sodium hydroxide aqueous solution was added to adjust pH to 10. Furthermore, 30 parts by mass of the dispersion of colorant particles (in terms of solid content) was put, and a solution obtained by dissolving 60 parts by mass of magnesium chloride in 60 parts by mass of ion-exchanged water was added under stirring at 30° C. over 10 minutes. After standing still for 3 minutes, the temperature of the resultant mixture was increased to 80° C. over 60 minutes, and after the temperature of the resultant solution reached 80° C., the stirring speed was adjusted such that the growth rate of particle size was 0.01 μm/min. Particles were allowed to grow until the volume-based median diameter measured by Coulter Multisizer 3 (manufactured by Beckman Coulter, Inc.) reached 6.0 μm.

Subsequently, 37 parts by mass of dispersion of amorphous polyester resin particles for the shell layer S1 (in terms of solid content) was put over 30 minutes, and at the time when the supernatant of the dispersion (reaction solution) became clear, an aqueous solution obtained by dissolving 190 parts by mass of sodium chloride in 760 parts by mass of ion-exchanged water was added thereto to stop the growth of particle size.

Furthermore, by heating and stirring the resultant solution at 80° C., fusion of particles was allowed to proceed, and at the time when the average circularity of the toner determined by using a measuring apparatus "FPIA-3000" (manufactured by Sysmex Corporation) reached 0.970, the resultant solution was cooled to 30° C. at a cooling rate of 2.5° C./min.

Subsequently, solid-liquid separation was carried out, and an operation in which a dewatered toner cake was dispersed in ion-exchanged water again and solid-liquid separation was carried out was repeated three times for washing. After drying the resultant at 40° C. for 24 hours, toner mother particles were obtained.

To 100 parts by mass of the obtained toner mother particles, 0.6 parts by mass of hydrophobic silica particles (number average primary particle size: 12 nm, hydrophobicity: 68), 1.0 part by mass of hydrophobic titanium oxide particles (number average primary particle size: 20 nm, hydrophobicity: 63), and 1.0 part by mass of sol-gel silica (number average primary particle size=110 nm) were added, and the resultant mixture was mixed at 32° C. for 20 minutes using a Henschel mixer (manufactured by Mitsui Miike Chemical Engineering Machinery, Co., Ltd.) with a circumferential speed of rotor blade of 35 mm/sec. After the mixing, coarse particles were removed using a sieve with 45 μm openings to obtain toner 1 (toner particles 1). It is noted that toner 1 was found to have a volume-based median diameter of 5.9 μm.

(Production of Toner 2)

In a reaction vessel equipped with a stirrer, a temperature sensor and a condenser, 285 parts by mass of dispersion of vinyl resin particles for the core particle 1 (in terms of solid content), 36 parts by mass of dispersion of crystalline polyester resin particles C1 (in terms of solid content), 1 mass % of sodium salt of dodecyl diphenyl ether disulfonic acid in the resin ratio (in terms of solid content), and 2,000 parts by mass of ion-exchanged water were put. At room temperature (25° C.), a 5 mol/L sodium hydroxide aqueous solution was added to adjust pH to 10. Furthermore, 30 parts by mass of the dispersion of colorant particles (in terms of solid content) was put, and a solution obtained by dissolving 60 parts by mass of magnesium chloride in 60 parts by mass of ion-exchanged water was added under stirring at 30° C. over 10 minutes. After standing still for 3 minutes, the temperature of the resultant mixture was increased to 80° C. over 60 minutes, and after the temperature of the resultant solution reached 80° C., the stirring speed was adjusted such that the growth rate of particle size was 0.01 μm/min. Particles were allowed to grow until the volume-based median diameter measured by Coulter Multisizer 3 (manufactured by Beckman Coulter, Inc.) reached 6.0 μm.

Subsequently, 37 parts by mass of dispersion of amorphous polyester resin particles for the shell layer S1 (in terms of solid content) was put over 30 minutes, and at the time when the supernatant of the dispersion (reaction solution) became clear, an aqueous solution obtained by dissolving 190 parts by mass of sodium chloride in 760 parts by mass of ion-exchanged water was added thereto to stop the growth of particle size.

Furthermore, by heating and stirring the resultant solution at 80° C., fusion of particles was allowed to proceed, and at the time when the average circularity of the toner determined by using a measuring apparatus "FPIA-3000" (manufactured by Sysmex Corporation) reached 0.970, the resultant solution was cooled to 30° C. at a cooling rate of 2.5° C./min.

Subsequently, solid-liquid separation was carried out, and an operation in which a dewatered toner cake was dispersed in ion-exchanged water again and solid-liquid separation was carried out was repeated three times for washing. After drying the resultant at 40° C. for 24 hours, toner particles were obtained.

To 100 parts by mass of the obtained toner particles, 0.6 parts by mass of hydrophobic silica particles (number average primary particle size: 12 nm, hydrophobicity: 68), 1.0 part by mass of hydrophobic titanium oxide particles (number average primary particle size: 20 nm, hydrophobicity: 63), and 1.0 part by mass of sol-gel silica (number average primary particle size=110 nm) were added, and the resultant mixture was mixed at 32° C. for 20 minutes using a Henschel mixer (manufactured by Mitsui Miike Chemical Engineering Machinery, Co., Ltd.) with a circumferential speed of rotor blade of 35 mm/sec. After the mixing, coarse particles were removed using a sieve with 45 m openings to obtain toner 2 (toner particles 2). It is noted that toner particles 2 were found to have a volume-based median diameter of 6.0 μm.

[Production of Toners 3 to 10]

Toners 3 to 10 (toner particles 3 to 10) were produced in the same manner as in toner 1 or toner 2 except that the type and the amount to be added (in terms of solid content) of the dispersion of vinyl resin particles for the core particle, the amount to be added (in terms of solid content) of the dispersion of crystalline polyester resin particles, and the type and the amount to be added (in terms of solid content) of the dispersion of resin particles for the shell layer were changed as described in Table 1 in the production of toner 1 or toner 2.

TABLE 1

| | Vinyl resin particles for core particle | | Crystalline polyester resin particles | | Resin particles for shell layer | | Toner | |
|---|---|---|---|---|---|---|---|---|
| Toner | Dispersion | Parts by mass (in terms of solid content) | Dispersion | Parts by mass (in terms of solid content) | Dispersion | Parts by mass (in terms of solid content) | Volume-based median diameter [μm] | Average circularity |
| 1 | 1 | 321 | — | 0 | S1 | 37 | 5.9 | 0.969 |
| 2 | 1 | 285 | C1 | 36 | S1 | 37 | 6.0 | 0.968 |
| 3 | 1 | 321 | — | 0 | S2 | 37 | 5.9 | 0.969 |
| 4 | 2 | 321 | — | 0 | S1 | 37 | 6.0 | 0.969 |
| 5 | 3 | 321 | — | 0 | S2 | 37 | 5.9 | 0.968 |
| 6 | 3 | 304 | C1 | 18 | S2 | 36 | 6.0 | 0.968 |
| 7 | 1 | 266 | C1 | 55 | S1 | 37 | 5.9 | 0.969 |
| 8 | 4 | 248 | C1 | 73 | S1 | 37 | 5.9 | 0.969 |
| 9 | 4 | 285 | C1 | 73 | — | 0 | 5.9 | 0.969 |
| 10 | 3 | 340 | — | 0 | S2 | 18 | 5.9 | 0.968 |

[Preparation of Developers 1 to 10]

To each of toners 1 to 10 (toner particles 1 to 10) prepared as described above, carrier particles covered with a silicone resin (ferrite carrier having a volume-based median diameter=60 μm) were added to prepare developers 1 to 10. Specifically, carrier particles and toner particles were mixed such that the toner concentration was 6 mass %, and developers 1 to 10 were prepared.

2. Image Formation and Evaluation 2-1. Image Formation

A developer was loaded in a remodeled machine of "AccurioPress C2060" (manufactured by Konica Minolta, Inc., "AccurioPress" being their registered trademark), and using the remodeled machine, a square patch image of 2 cm×2 cm was formed on the recording medium described above, and a toner image (resin layer) having the patch image on the recording medium was output. It is noted that the recording medium used was "New color R Yuki" (manufactured by Lintec Corporation).

The above-described recording medium having the toner image formed thereon was heated for 10 seconds on a hot plate set at 95° C. to soften the resin layer. The softened resin layer was pressed with a sponge roller to which a powder was caused to adhere, and the power was supplied to the toner image. The rubbing was carried out by rubbing the recording medium with a roller rotated in a direction reverse to the conveyance direction during the conveyance. Specifically, the rubbing was carried out by pressing the toner image with a sponge roller to which a powder was caused to adhere and rotating the roller. The pressure at the time of pressing and rubbing is about 10 kPa. After the supply of the powder or after the rubbing, the powder that did not adhere to the resin layer was removed from the surface of the image by a brush to obtain a decorated image.

It is noted that the following powders 1 to 7 were used for the decoration.

powder 1: trial product composed of particles that are metal particles and flat particles (manufactured by Powdertech Co., Ltd.)

powder 2: Unicorn Powder (manufactured by coconail)

powder 3: trial product composed of particles that are metal particles and flat particles (manufactured by Powdertech Co., Ltd.)

powder 4:

powder 5: trial product composed of particles that are MetaShine ME2025PSS2 metal particles and flat particles (manufactured by Powdertech Co., Ltd.) (manufactured by Nippon Sheet Glass Co., Ltd.)

powder 6: MetaShine ME2025PS (manufactured by Nippon Sheet Glass Co., Ltd.)

powder 7: UBS-0010E (manufactured by UNITIKA LTD.)

2-2. Evaluation (Arithmetic Mean Height Sa of Surface of Powder)

Arithmetic mean heights Sa's of region 1 (front) and region 2 (back) of a powder were measured using VK-X200 Series (manufactured by Keyence Corporation). Specifically, an image of each of region 1 (front) of the powder and region 2 (back) of the powder was obtained using a 150× objective lens, and correction of surface inclination was carried out on the basis of one particle. A region of 10 μm×10 μm in the particle that has been subjected to the inclination correction was selected and Sa was measured. It is noted that the region to be measured was modified appropriately depending on the size of a particle. Measurement results of arithmetic mean heights Sa's of the surface of powders are shown in the following Table 2. It is noted that powders 1 to 6 are powders composed of particles that are metal particles and flat particles, and powder 7 is a powder composed of spherical particles.

TABLE 2

| | Arithmetic mean height Sa [nm] of surface | |
|---|---|---|
| Powder | Region 1 (front) | Region 2 (back) |
| 1 | 180 | 12 |
| 2 | 75 | 10 |
| 3 | 190 | 50 |
| 4 | 33 | 33 |
| 5 | 268 | 268 |
| 6 | 7 | 7 |
| 7 | 8 | 8 |

(Measurement of Storage Modulus G' of Toners 1 to 10)

For each of the above-described toners 1 to 10, 0.2 g was weighed, and subjected to compression molding by applying a pressure of 25 MPa with a compression molding machine to produce a columnar pellet with a diameter of 10 mm.

Measurement of storage modulus G' was carried out by using a rheometer (manufactured by TA Instruments—Waters Corporation: ARES G2), setting a parallel plate with a diameter of 8 mm and a parallel plate with a diameter of 25 mm on and under the columnar pellet, respectively, and increasing the temperature under conditions of a frequency of 1 Hz. Sample setting was carried out at 100° C., and after setting the gap at 1.4 mm once, a sample protruding from the gap between the plates was scraped, and the gap was then reset at 1.1 mm. While applying axial force, the sample was cooled to 30° C. and left at rest for 10 minutes. Thereafter, the application of axial force was stopped, and measurement of storage modulus G' was carried out from 30° C. to 100° C. under conditions of a frequency of 1 Hz and a temperature increasing rate of 3° C./min. Upon this, storage modulus G' at 90° C. was defined as storage modulus G'(1).

Besides, the application of axial force was stopped, and measurement of storage modulus G' was carried out from 30° C. to 100° C. under conditions of a frequency of 1 Hz and a temperature increasing rate of 3° C./min.

Upon this, storage modulus G' at 40° C. was defined as storage modulus G'(2).

It is noted that details of measurement conditions were as follows.

Frequency: 1 Hz
Temperature increasing rate: 3° C./min
Axial force: 0 g
Sensitivity: 10 g
Initial strain: 0.01%
Strain adjustment: 30.0%
Minimum strain: 0.01%
Maximum strain: 10.0%
Minimum torque: 1 g-cm
Maximum torque: 80 g-cm
Sampling interval: 1.0° C./pt (Tape Detachability (Mending Tape Peeling Method))

Fixation strength of the obtained decorated image was evaluated by a mending tape peeling method. Now, the mending tape peeling method will be described.

1) A photo of the obtained decorated image was taken with a magnification of 100 times using a digital microscope VHX-6000 manufactured by Keyence Corporation, and the photo was subjected to a binarization processing with LUSEX-AP manufactured by NIRECO CORPORATION to distinguish a part covered with a powder from a part not covered with a powder in the decorated image. In this manner, the covering ratio of the decorated image with the powder was calculated as follows.

Covering ratio (%) of decorated image with powder={(Area of part covered with powder in decorated image)/(Area of decorated image)}×100

2) To the decorated image, "mending tape" (manufactured by Sumitomo 3M Ltd.: NO. 810-3-12) was lightly applied.

3) A weight having the bottom face of 5 cm×5 cm was rubbed against the tape by moving it back and forth 3.5 times with a pressure of 1 kPa.

4) Peeling test was carried out by peeling the tape at an angle of 180° C. and a force of 200 g.

5) A photo of the decorated image after the peeling test was taken with a magnification of 100 times using a digital microscope VHX-6000 manufactured by Keyence Corporation, and the photo was subjected to a binarization processing with LUSEX-AP manufactured by NIRECO CORPORATION. As a result, the covering ratio of the decorated image after the peeling with the powder was calculated in the same manner as described above.

6) Peeling rate was calculated as follows.

Peeling rate[%]=100−{(Covering ratio of decorated image after peeling test with powder/Covering ratio of decorated image with powder)}×100

A peeling rate of 5% or less was defined as A, a peeling rate of greater than 5% and less than 11% was defined as B, and a peeling rate of 11% or more was defined as C.

(Organoleptic Evaluation)

Appearance of the final image was visually observed by 10 skilled technicians and evaluated as follows. All judgments below for Examples and Comparative Examples were consistent in all the members.

with glittering effect (powder particles are randomly aligned in a state where some particles are pushed into the resin layer, and irregular reflection can be seen visually and projection of the image is not substantially seen)

with cyan pearl-like glittering effect (powder particles are randomly aligned in a state where some particles are pushed into the resin layer and some are aligned along with the surface of the resin layer, and therefore, not only glittering effect due to irregular reflection can be visually seen, but also turbidity and luster due to pearl tone can be slightly seen)

with nonuniform glittering effect (a nonuniform state where the image is rubbed, concentration difference in color of the resin layer occurs, or the underlying recording medium can be seen)

with matte tone (a state where feeling of luster in the underlying image does not exist because spherical particles adhere thereto, and the degree of luster is low)

TABLE 3

| | | Powder | | | | | | | Evaluations | | |
|---|---|---|---|---|---|---|---|---|---|---|---|
| | | Storage modulus | | | | Surface roughness Sa [nm] | | | Tape peeling | | Visual |
| | Developer | G'(1) [Pa] at 90° C. | G'(2) [Pa] at 40° C. | Number | Shape | Region 1 (front) | Region 2 (back) | Rubbing step | evaluation Peeling rate [%] | | evaluation of final image |
| Ex. 1 | Developer 1 | $1.61 \times 10^5$ | $7.65 \times 10^8$ | 1 | Flat | 180 | 12 | Present | 2 | A | With glittering effect |
| Ex. 2 | Developer 1 | $1.61 \times 10^5$ | $7.65 \times 10^8$ | 2 | Flat | 75 | 10 | Present | 3 | A | With glittering effect |
| Ex. 3 | Developer 1 | $1.61 \times 10^5$ | $7.65 \times 10^8$ | 3 | Flat | 190 | 50 | Present | 4 | A | With glittering effect |
| Ex. 4 | Developer 1 | $1.61 \times 10^5$ | $7.65 \times 10^8$ | 4 | Flat | 33 | 33 | Present | 3 | A | With glittering effect |
| Ex. 5 | Developer 1 | $1.61 \times 10^5$ | $7.65 \times 10^8$ | 5 | Flat | 268 | 268 | Present | 6 | B | With glittering effect |
| Ex. 6 | Developer 1 | $1.61 \times 10^5$ | $7.65 \times 10^8$ | 6 | Flat | 7 | 7 | Present | 5 | A | With glittering effect |
| Ex. 7 | Developer 1 | $1.61 \times 10^5$ | $7.65 \times 10^8$ | 7 | Spherical | 8 | 8 | Present | 9 | B | With matte tone |
| Ex. 8 | Developer 1 | $1.61 \times 10^5$ | $7.65 \times 10^8$ | 1 | Flat | 180 | 12 | Absent | 10 | B | With glittering effect |
| Ex. 9 | Developer 2 | $2.09 \times 10^4$ | $3.10 \times 10^8$ | 1 | Flat | 180 | 12 | Present | 3 | A | With glittering effect |
| Ex. 10 | Developer 3 | $8.82 \times 10^4$ | $7.32 \times 10^8$ | 1 | Flat | 180 | 12 | Present | 4 | A | With glittering effect |
| Ex. 11 | Developer 4 | $1.42 \times 10^5$ | $3.99 \times 10^8$ | 1 | Flat | 180 | 12 | Present | 5 | A | With glittering effect |
| Ex. 12 | Developer 5 | $9.91 \times 10^5$ | $1.04 \times 10^9$ | 1 | Flat | 180 | 12 | Present | 10 | B | With glittering effect |
| Ex. 13 | Developer 6 | $7.80 \times 10^5$ | $9.30 \times 10^8$ | 1 | Flat | 180 | 12 | Present | 8 | B | With glittering effect |
| Ex. 14 | Developer 7 | $1.22 \times 10^4$ | $1.30 \times 10^8$ | 1 | Flat | 180 | 12 | Present | 4 | A | With nonuniform glittering effect |
| Ex. 15 | Developer 8 | $1.24 \times 10^3$ | $1.11 \times 10^8$ | 1 | Flat | 180 | 12 | Present | 3 | A | With nonuniform glittering effect |
| Ex. 16 | Developer 9 | $1.12 \times 10^4$ | $9.83 \times 10^7$ | 1 | Flat | 180 | 12 | Present | 10 | B | With glittering effect |

TABLE 3-continued

| | | Storage modulus | | Powder | | Surface roughness Sa [nm] | | | Evaluations | | |
|---|---|---|---|---|---|---|---|---|---|---|---|
| | Developer | G'(1) [Pa] at 90° C. | G'(2) [Pa] at 40° C. | Number | Shape | Region 1 (front) | Region 2 (back) | Rubbing step | Tape peeling evaluation Peeling rate [%] | | Visual evaluation of final image |
| Comp. Ex. 1 | Developer 10 | $1.10 \times 10^6$ | $1.14 \times 10^9$ | 1 | Flat | 180 | 12 | Present | 16 | C | With cyan pearl-like glittering effect |
| Comp. Ex. 2 | Developer 10 | $1.10 \times 10^6$ | $1.14 \times 10^9$ | 3 | Flat | 190 | 50 | Present | 16 | C | With cyan pearl-like glittering effect |
| Comp. Ex. 3 | Developer 10 | $1.10 \times 10^6$ | $1.14 \times 10^9$ | 5 | Flat | 268 | 268 | Present | 16 | C | With cyan pearl-like glittering effect |

As is obvious from Table 3, the tape peeling evaluation for Examples 1 to 16 having a storage modulus G'(1) of the resin layer of $1.0\times10^3$Pa or more and $1.0\times10^6$ Pa or less was satisfactory compared to Comparative Examples 1 to 3 having G'(1) of $1.10\times10^6$ Pa exceeding the upper limit of the above-described range.

The tape peeling evaluation for Example 1 having a storage modulus G'(1)of the resin layer in the range of $1.3\times10^4$ Pa or more and $7.0\times10^5$ Pa or less was satisfactory compared to Examples 12 and 13 with the same conditions as Example 1 except that they have G'(1) of $9.91\times10^5$ Pa and $7.80\times10^5$ Pa, respectively, exceeding the upper limit of the above-described range.

Besides, Example 1 provided an image having a glittering effect and the visual evaluation of the final image was satisfactory compared to Examples 14 and 15 having G'(1) of $1.22\times10^4$ Pa and $1.24\times10^3$ Pa, respectively, going below the lower limit of the above-described range.

The tape peeling evaluation for Examples 1 and 9 to 11 having a storage modulus G'(2) of the resin layer of $1.0\times10^8$ Pa or more was satisfactory compared to Example 16 with almost the same conditions as them except that it has G'(2) of $9.83\times10^7$ Pa lower than the above-described range.

The tape peeling evaluation for Example 1 that had been subjected to the rubbing was satisfactory compared to Example 8 with the same conditions except that it had not been subjected to the rubbing.

The tape peeling evaluation for Examples 1 to 4 having an arithmetic mean height Sa of the surface of the powder particle of 8 nm or more and 250 nm or less was satisfactory compared to Examples 5 and 6 with the same conditions as them except that the former has Sa of 268 nm exceeding the upper limit of the abovdescribed range and the latter has Sa of 7 nm going below the lower limit of the above-described range.

INDUSTRIAL APPLICABILITY

The present invention can provide an image forming method in which a powder is unlikely to be detached from an image that has been decorated with the powder. An image forming method for decorating an image can be expected to further spread by the present invention.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming method for forming a decorated image having a resin layer and a powder contacted with each other, the method comprising:

forming a resin layer on a recording medium, the resin layer having, in viscoelasticity measurement, a storage modulus G'(1)at 90° C. of $1.0\times10^3$ Pa or more and $1.0\times10^6$ Pa or less upon carrying out the measurement from 30° C. to 100° C. under conditions of a frequency of 1 Hz and a temperature increasing rate of 3° C./min; and supplying a powder onto the recording medium.

2. The image forming method according to claim 1, wherein, in viscoelasticity measurement of the resin layer, the storage modulus G'(1)is $1.3\times10^4$ Pa or more and $7.0\times10^3$ Pa or less.

3. The image forming method according to claim 1, wherein, in viscoelasticity measurement of the resin layer, storage modulus G'(2) at 40° C. is $1.0\times10^8$ Pa or more upon carrying out the measurement from 30° C. to 100° C. under conditions of a frequency of 1 Hz and a temperature increasing rate of 3° C./min.

4. The image forming method according to claim 1, further comprising softening the resin layer.

5. The image forming method according to claim 4, wherein the softening of the resin layer is performed by heating the resin layer.

6. The image forming method according to claim 4, wherein the supplying of a powder is performed by supplying a powder onto a surface of the softened resin layer.

7. The image forming method according to claim 6, comprising aligning the powder supplied onto the surface of the resin layer.

8. The image forming method according to claim 7, wherein the alignment of the powder is performed by rubbing the surface of the resin layer onto which the powder has been supplied.

9. The image forming method according to claim 8, wherein the rubbing of the surface of the resin layer onto which the powder has been supplied is performed by moving either one or both of a resin image and a rubbing member such that a relative speed difference between the resin image and the rubbing member is generated, the rubbing member being disposed in contact with the surface of the resin layer.

10. The image forming method according to claim 1, wherein the powder contains a powder particle.

11. The image forming method according to claim 10, wherein the powder particle has a surface with an arithmetic mean height Sa of 8 nm or more and 250 mm or less.

12. The image forming method according to claim 10, wherein the powder particle is a flat particle.

13. The image forming method according to claim 10, wherein the powder particle is a metal particle.

14. The image forming method according to claim 1, wherein the resin layer contains a toner particle.

15. An image forming method for forming a decorated image, comprising:

softening a resin layer included in a resin image formed on a recording medium, the resin layer having, in viscoelasticity measurement, a storage modulus G'(1)at 90° C. of $1.0\times10^3$ Pa or more and $1.0\times10^6$ Pa or less upon carrying out the measurement from 30° C. to 100° C. under conditions of a frequency of 1 Hz and a temperature increasing rate of 3° C./min; and supplying a powder onto a surface of the resin layer.

* * * * *